US006918425B2

(12) United States Patent
Nien

(10) Patent No.: US 6,918,425 B2
(45) Date of Patent: Jul. 19, 2005

(54) NON-PULL CORD OPERABLE VENETIAN BLIND

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/649,811

(22) Filed: Aug. 28, 2003

(65) Prior Publication Data

US 2005/0045281 A1 Mar. 3, 2005

(51) Int. Cl.[7] ..... E06B 9/30

(52) U.S. Cl. ..... 160/172 R; 160/173 R; 160/278

(58) Field of Search ..... 160/84.06, 172 R, 160/178.2 R, 168.1 R, 173 R, 170, 278, 243, 246; 16/199

(56) References Cited

U.S. PATENT DOCUMENTS

| | | | | |
|---|---|---|---|---|
| 577,244 A | * | 2/1897 | Emery | 160/279 |
| 593,929 A | * | 11/1897 | Forsyth | 160/279 |
| 6,681,831 B1 | * | 1/2004 | Cheng et al. | 160/84.06 |
| 2003/0230388 A1 | * | 12/2003 | Padiak et al. | 160/84.06 |

* cited by examiner

*Primary Examiner*—Blair M. Johnson
(74) *Attorney, Agent, or Firm*—Troxell Law Office, PLLC

(57) ABSTRACT

A non-pull cord operable Venetian blind includes a retaining device located at each end of a lower beam of a Venetian blind therein in working with a retaining cord. The retaining device is made up of a holding sleeve, a driven member adapted at the holding sleeve therein, a limiting spring joined to one side of the driven member with a pair of left and right stop legs protruding at a limiting hole of the holding sleeve, a rotary member to activate the driven member therewith, and an outer cap applied at the outer side of the holding sleeve. The retaining cord is wound through alternative left and right blades of the rotary member and clamped by abutting ribs of the holding sleeve before led straight downwards to be securely located at a windowsill at the bottom end thereof. Via the guidance of the retaining cord, the rotary member of the retaining device is rotated either counter-clockwise when the lower beam is pushed upwards to gather up the Venetian blind, or clockwise when the lower beam is drawn downwards to unfold the Venetian blind thereof. Meanwhile, three layers of frictional resistance are formed therewith in operation, ensuring the smooth and precise movements of the Venetian blind without any other pull cords applied thereon so as to keep the safety of children in the household.

6 Claims, 4 Drawing Sheets

NON-PULL CORD OPERABLE VENETIAN BLIND

BACKGROUND OF THE INVENTION

The present invention is related to a non-pull cord operable Venetian blind, including a retaining device located at each end of a lower beam of a Venetian blind therein in working with a retaining cord. The retaining device is made up of a holding sleeve, a driven member adapted at the holding sleeve therein, a limiting spring joined to one side of the driven member, a rotary member to activate the driven member therewith, and an outer cap applied at the outer side of the holding sleeve thereof; whereby, the retaining cord thereof is led through the retaining device with three layers of frictional resistance formed therewith in operation, ensuring the precise upwards or downwards movements of the Venetian blind without any other pull cords applied thereon in order to keep the safety of children in the household.

A conventional Venetian blind is usually made up of a volute wheel unit in working with pull cords and T-cords, which is not only tediously complex in assembly, but also quite dangerous to children in the household. When the Venetian blind is gathered up, pull cords are suspended downwards for a certain length outside the blind thereof. Children playing around the blind may easily get caught by the suspending pull cords. In case the blind is careless unfolded, the withdrawing pull cords might hurt or even strangle the children got caught in them. Thus, the conventional Venetian blind poses a potential danger to children in the household.

SUMMARY OF THE PRESENT INVENTION

It is, therefore, the primary purpose of the present invention to provide a non-pull cord operable Venetian blind, including a retaining device located at each end of a lower beam of a Venetian blind therein in working with a retaining cord. The retaining device is made up of a holding sleeve, a driven member, a limiting spring, a rotary member, and an outer cap, through which the retaining cord is led with three layers of frictional resistance formed therewith, facilitating the precise upwards or downwards movement of the Venetian blind in gathering or unfolding operation under the best using condition.

It is, therefore, the secondary purpose of the present invention to provide a non-pull cord operable Venetian blind wherein the retaining cord wound through the retaining device is led straight downwards to be located at a window sill at the bottom end without any other pull cords applied thereon, refraining from the danger of hurting or choking children by the neck in order to ensure the safety of children in the household.

It is, therefore, the third purpose of the present invention to provide a non-pull cord operable Venetian blind wherein the Venetian blind is smoothly and precisely gathered up or unfolded via the retaining device in working with the retaining cord without any other volute wheel unit, pull cords, or T-cords applied thereon, economically cutting down the parts of assembly and the costs of materials as well as facilitating the assembly of the present invention in an easy and fast manner.

DETAILED DESCRIPTION OF THE PREFERRED EMBODIMENTS

Figure 1:
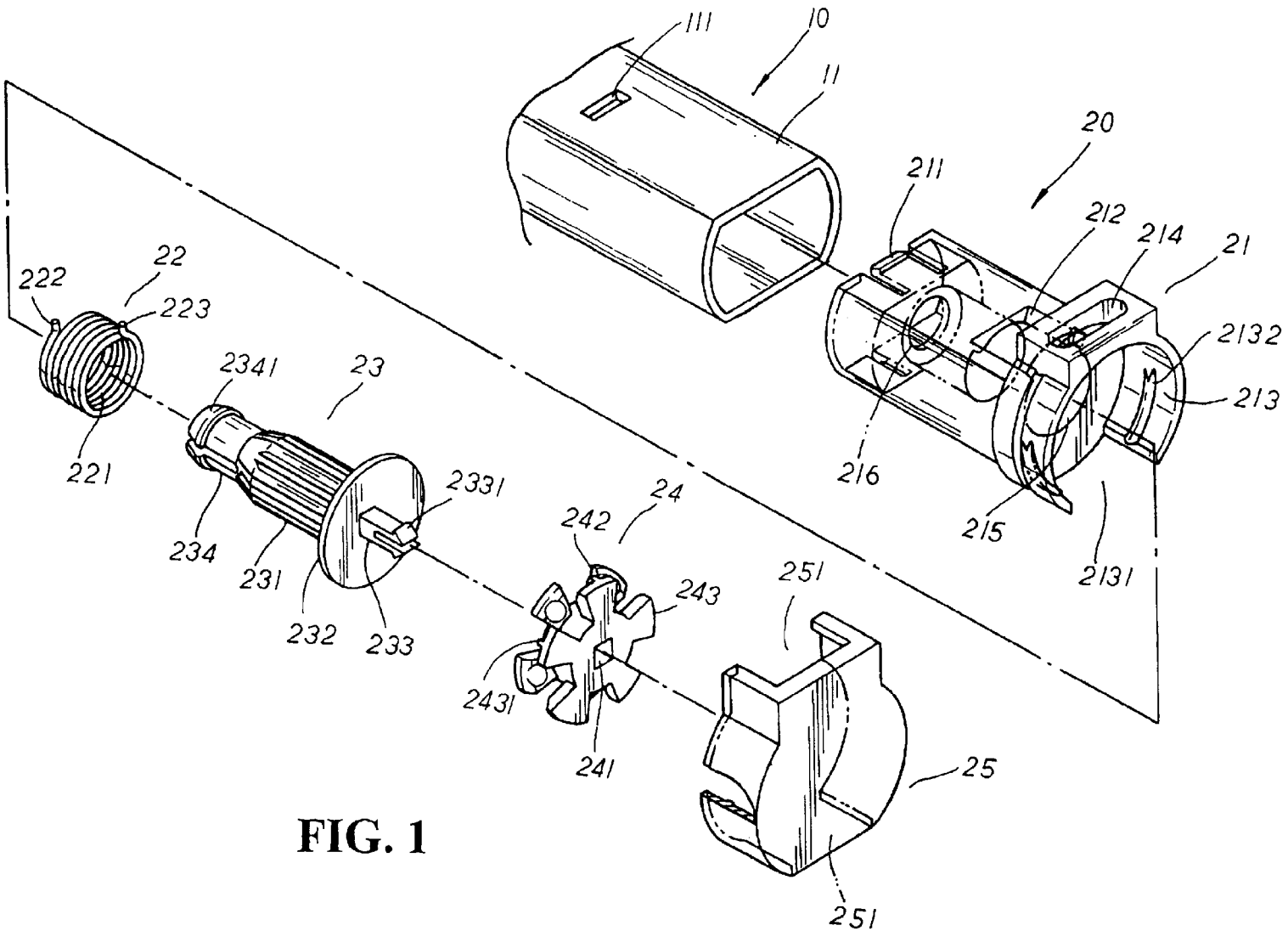
FIG. 1 is a perspective exploded view of the present invention.

Please refer to FIG, 1. The present invention is related to a non-pull cord operable Venetian blind, including a Venetian blind 10 and a lower beam 11 wherein the lower beam 11 has a fixing hole 111 disposed at both the upper and lower sides of both ends thereof respectively for a retaining device 20 to be located at the lower beam thereby. The retaining device 20 is made up of a holding sleeve 21, a limiting spring 22, a driven member 23, a rotary member 24, and an outer cap 25. The holding sleeve 21 has a pair of symmetrical flexible hook plates 211 disposed at the upper and lower periphery of one end thereof, a limiting hole 212 disposed at the middle section thereof, and a semicircular receiving cavity 213 with a bottom opening 2131 defined at the other end thereof. A pair of arc abutting ribs 2132 is symmetrically defined at the opposite inner wall of the receiving cavity 213 thereon, and an upper through hole 214 is protruded at the top of the receiving cavity 213 thereof. A stepwise tunnel 215 is extending at the inner middle section of the holding sleeve 21 communicating with the receiving cavity 213 at one end and ended with a small through hole 216 at the other end thereof. The limiting spring 22 has a sleeve hole 221 disposed at the center thereof, and a pair of left and right stop legs 222, 223 protruding correspondingly at both ends thereof. The driven member is made up of a sleeve rod 231 extending at the middle section thereof, a circular abutting part 232 disposed at one side of the sleeve rod 231 thereof, a flexible rotary shaft 233 with a pair of symmetrical hooks 2331 protruding outwards from the center of the circular abutting part 232 thereof, and a pair of flexible plates 234 each with a stepwise hook flange 2341 symmetrically extending at the other side of the sleeve rod 231 thereof. The rotary member 24 is provided with a rectangular sleeve hole 241 defined at the center thereof, and a plurality of left and right blades 242, 243 extending alternatively in a fan-like manner at both sides thereof wherein each right blade 243 has a rib 2431 protruding at the corresponding inner side thereof. The outer cap 25 has an upper and a lower recesses 251 defined at both ends thereof, correspondingly matched to the receiving cavity 213 of the holding sleeve 21 thereof.

Figure 2:
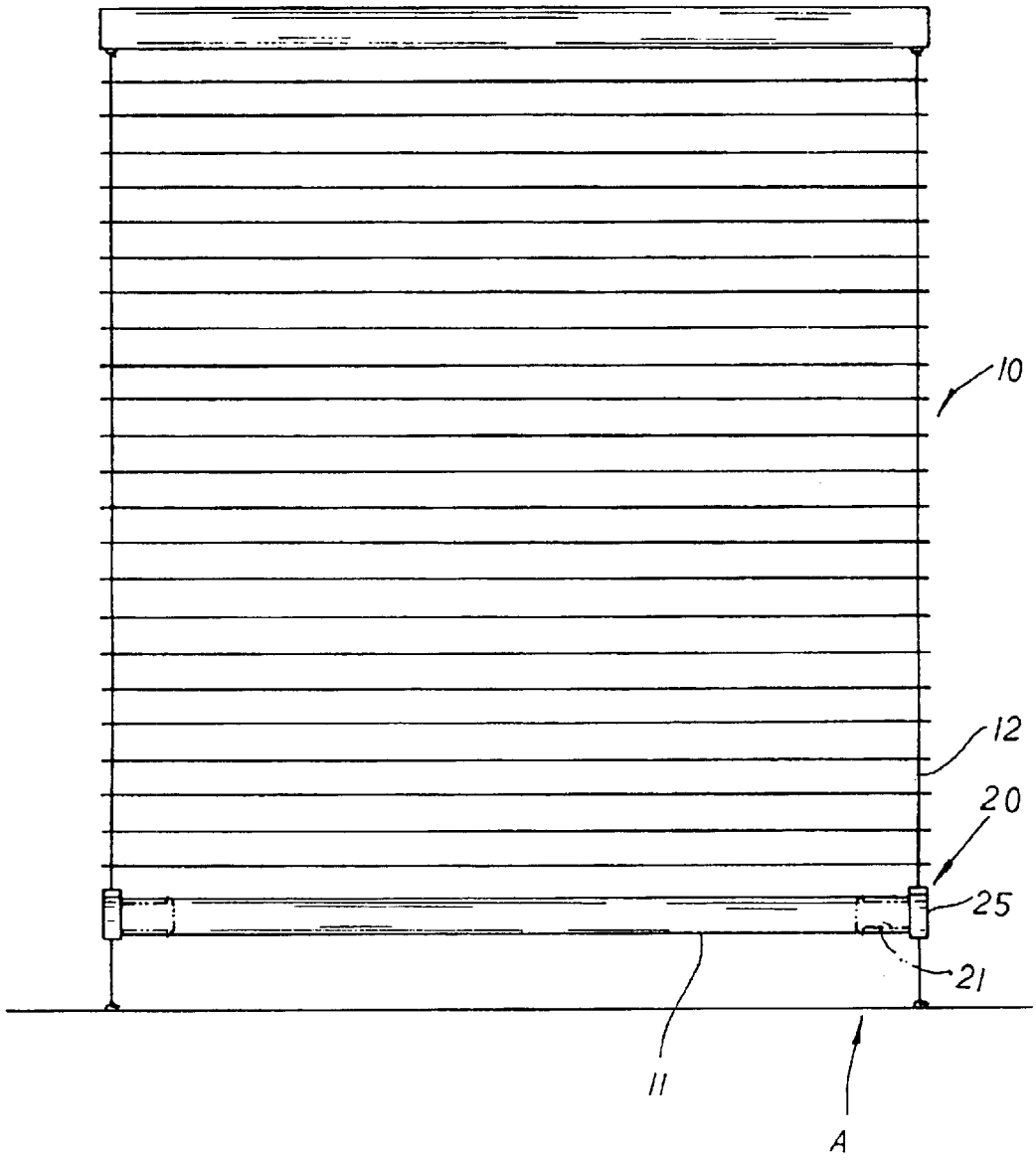
FIG. 2 is a sectional view of the present invention in assembly.
Figure 3:
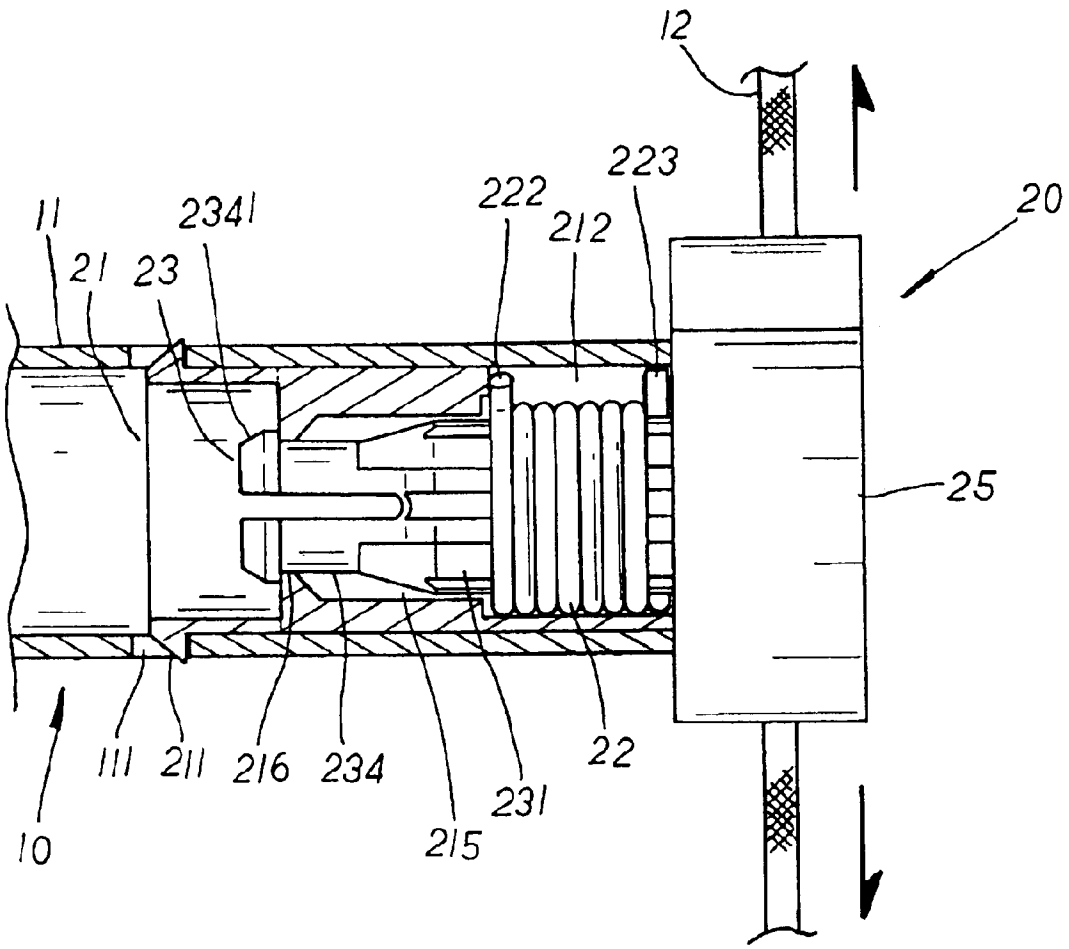
FIG. 3 is a cross section view of the present invention in operation.

Please refer to FIGS. 2, 3. In assembly, the sleeve hole 221 of the limiting spring 22 is joined to the sleeve rod 231 of the driven member 23 till abutted against the circular abutting part 232 thereof. The driven member 23 is then led to the receiving cavity 213 of the retaining sleeve 21 and adapted at the stepwise tunnel 215 therein with the hook flanges 2341 of the flexible plates 234 thereof passed through the small through hole 216 and fixed at the outer periphery thereon for location. The left and right stop legs 222, 223 of the limiting spring 22 are protruded upwards at the limiting hole 212 thereof, and the circular abutting part 232 adapted and abutted at the receiving cavity 213 therein. The rectangular sleeve hole 241 of the rotary member 24 is then led to the flexible rotary shaft 233 of the driven member 23 till the symmetrical hooks 2331 thereof securely hooked to the outer periphery of the right blades 243 thereof. The outer cap 25 is then applied onto the receiving cavity 213 with the upper and lower recesses 251 correspondingly matched to the upper through hole 214 and the bottom opening 2131 thereof respectively to complete the assembly of the retaining device 20 thereof. The retaining device 20 is adapted at both ends of the lower beam 11 thereof respectively and fixedly located therein via the flexible hook plates 211 of the holding sleeve 21 securely engaged with the fixing holes 111 of the lower beam 11 thereof.

Figure 4:
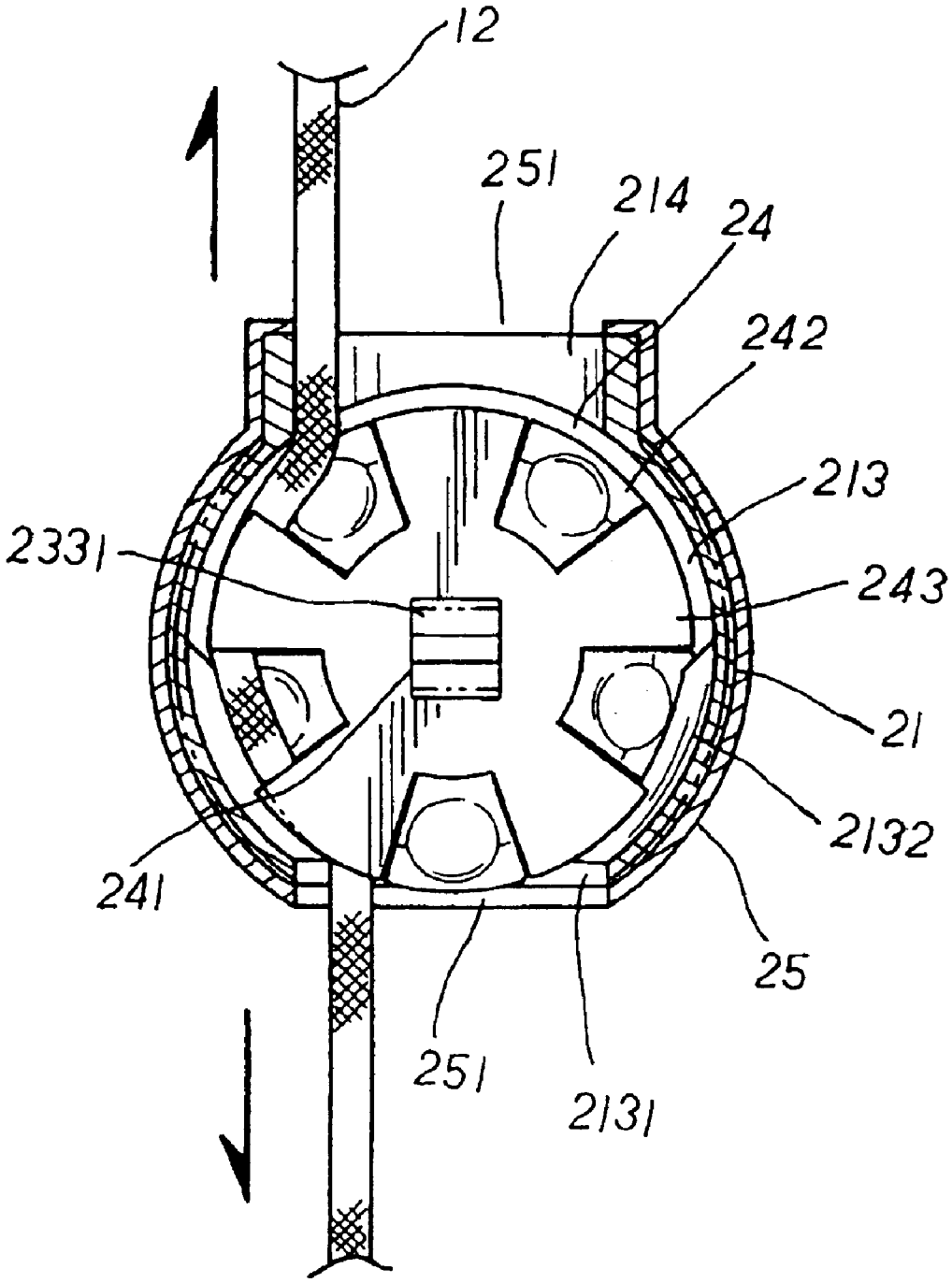
FIG. 4 is a cross sectional diagram showing a rotary member in working with a retaining cord of the present invention in operation.

Please refer to FIG. 4. The outer cap 25 is removed from the retaining device 20 thereof for a retaining cord 12 disposed at both lateral sides of the Venetian blind 10 thereof respectively to be adapted at the retaining device 20 therein. The retaining cord 12 is led through the upper through hole 214 of the holding sleeve 21 thereof and wound through the alternative left and right blades 242, 243 of the rotary member 24 in clamping abutment there-between to form the first layer of frictional resistance of the retaining cord 12 in operation. When the rotary member 24 is rotated to activate the driven member 23 therewith, the limiting spring 22 with the left and right stop legs 222, 223 circumscribed by the lateral walls of the limiting hole 212 thereof will cut down the rotating speed of the rotary member 24 to form a second layer of frictional resistance in operation thereof. Moreover, the retaining cord 12, guided downwards through the abutting ribs 2132 of the receiving cavity 213 thereof, is clamped between the ribs 2431 of the right blades 243 and the abutting ribs 2132 of receiving cavity 213 thereof to form a third layer of frictional resistance thereof as shown in FIG. 4. The retaining cord 12, guided out of the bottom opening 2131 of the receiving cavity 213 thereof, is led straight downwards and securely fixed to a window sill A at the bottom end thereof without any other pull cords applied thereon. Thus, children in the household are safely prevented from the danger of careless getting caught or choke by pull cords of a blind when playing around.

In practical use, the lower beam 11 of the Venetian blind 10 is either pushed upwards or drawn downwards to gather up or unfold the Venetian blind 10 thereof. Via the guidance of the retaining cord 12, the rotary member 24 of the retaining device 20 will rotate counter-clockwise upwards to gather up the Venetian blind 10 thereof when the lower beam 11 thereof is pushed upwards. Otherwise, the rotary member 24 thereof is rotated clockwise downwards to unfold the Venetian blind 10 thereof. Thus, via the three layers of frictional resistance formed by the rotary member 24, the abutting ribs 2132 of the holding sleeve 21, and the driven member 23 with the limiting spring 22 in working with the retaining cord 12 thereof respectively, the Venetian blind 10 thereof is smoothly and precisely operated upwards or downwards in withdrawal or unfolding under the best using condition.

What is claimed is:

1. An adjustment device for a Venetian blind connected to a window sill comprising:

a) a lower beam having a fixing hole located through a top and a bottom of each of two opposing ends thereof; and b) two retaining devices, each of the two retaining devices having:

i) a holding sleeve having a retaining cavity, a first end of the holding sleeve being inserted into one of the two opposing ends of the lower beam;

ii) a limiting spring;

iii) a driven member having a first end inserted through the limiting spring, the first end of the driven member and the limiting spring being inserted into the holding sleeve;

iv) a rotary member connected to a second end of the holding sleeve and having a plurality of alternating left and right blades positioned in the retaining cavity, the rotary member being rotatable in clockwise and counter clockwise directions; and v) an outer cap connected to a second end of the holding sleeve, wherein an end of each of two retaining cords of the Venetian blind is inserted through the fixing hole in the top of one of the two opposing ends of the lower beam, through the plurality of alternating left and right blades, through the fixing hole in the bottom of one of the two opposing ends of the lower beam, and connected to a bottom of the window sill, the lower beam being movable along a length of the two retaining cords and held in a predetermined position by friction forces created by the two retaining devices.

2. The adjustment device according to claim 1, wherein each holding sleeve further comprising:

a) a pair of symmetrical flexible hook plates located on a top and a bottom of the first end thereof, each of the pair of symmetrical flexible hook plates being inserted into one fixing hole of the lower beam;

b) a first end through hole located on the first end;

c) a limiting hole located in a middle portion thereof;

d) a semicircular receiving cavity located on the second end thereof and having:

i) a bottom opening;

ii) an interior wall;

iii) a pair of arc abutting ribs symmetrically positioned on opposite sides of the interior wall; and iv) an upper through hole located in a top thereof; and e) a stepwise tunnel located in the middle portion and communication with the first end through hole on a first tunnel end and the semicircular receiving cavity on a second tunnel end.

3. The adjustment device according to claim 1, wherein each limiting spring has a sleeve hole located through a center and a stop leg located at each of two ends thereof, the first end of the driven member is inserted through the sleeve hole.

4. The adjustment device according to claim 1, wherein each driven member further comprising:

a) a pair of flexible plates located on a first end thereof, each of the pair of flexible plates having a stepwise hook flange extending outwardly from an outer periphery;

b) a sleeve rod located adjacent to the pair of flexible plates;

c) a flexible rotary shaft with a pair of symmetrical hooks located on a second end thereof; and d) a circular abutting part located between the sleeve rod and the flexible rotary shaft.

5. The adjustment device according to claim 1, wherein each rotary member further comprising:

a) a rectangular sleeve hole located through a center thereof; and b) a rib protruding from an inner side of each of the plurality of alternating right blades.

6. The adjustment device according to claim 1, wherein each outer cap has an upper recess located in a top thereof and a lower recess located in a bottom thereof, the upper and lower recessed aligned with an upper through hole and a bottom opening of each holding sleeve.

* * * * *